US008640362B2

(12) United States Patent
Lafortune

(10) Patent No.: US 8,640,362 B2
(45) Date of Patent: Feb. 4, 2014

(54) ARTICLE OF FOOTWEAR WITH A REMOVABLE FOOT-SUPPORTING INSERT

(75) Inventor: Mario Angelbert Lafortune, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 253 days.

(21) Appl. No.: 13/037,542

(22) Filed: Mar. 1, 2011

(65) Prior Publication Data

US 2011/0146104 A1 Jun. 23, 2011

Related U.S. Application Data

(62) Division of application No. 12/561,300, filed on Sep. 17, 2009, now Pat. No. 7,900,379, which is a division of application No. 11/354,570, filed on Feb. 13, 2006, now Pat. No. 7,600,332.

(51) Int. Cl.
*A43B 3/24* (2006.01)

(52) U.S. Cl.
USPC ..... 36/100; 36/43

(58) Field of Classification Search
USPC ..... 36/100, 43, 15, 101, 44; 12/142 N
See application file for complete search history.

(56) References Cited

U.S. PATENT DOCUMENTS

| | | | | |
|---|---|---|---|---|
| 1,907,997 | A | 5/1933 | Nickerson | |
| 2,183,277 | A | 12/1939 | Heilhecker | |
| 2,519,108 | A | 8/1950 | Bryant et al. | |
| 2,875,532 | A * | 3/1959 | Fitzsimmons | 36/36 R |
| 2,940,187 | A | 6/1960 | Mitchell | |
| 3,253,600 | A * | 5/1966 | Scholl | 36/141 |
| 3,878,626 | A | 4/1975 | Isman | |
| 3,890,725 | A | 6/1975 | Lea et al. | |
| 4,045,886 | A | 9/1977 | Terasaki | |
| 4,606,139 | A | 8/1986 | Silver | |
| 4,727,661 | A | 3/1988 | Kuhn | |
| 4,742,625 | A | 5/1988 | Sydor et al. | |
| 4,760,654 | A | 8/1988 | Limbach | |
| 4,813,162 | A | 3/1989 | Harris | |
| 4,869,001 | A | 9/1989 | Brown | |
| 4,887,369 | A | 12/1989 | Bailey et al. | |
| 5,394,626 | A | 3/1995 | Brown | |
| 5,595,005 | A | 1/1997 | Throneburg et al. | |
| 5,915,820 | A | 6/1999 | Kraeuter et al. | |
| 5,921,009 | A | 7/1999 | Hice | |
| 6,092,305 | A | 7/2000 | Troy et al. | |
| 6,092,311 | A | 7/2000 | MacNamara | |

(Continued)

OTHER PUBLICATIONS

One page redacted excerpt from a letter dated Apr. 21, 2010 from a Third Party to Nike, Inc.

*Primary Examiner* — Ted Kavanaugh
(74) *Attorney, Agent, or Firm* — Banner & Witcoff, Ltd.

(57) ABSTRACT

An article of footwear is disclosed that includes an upper that defines an interior void, a sole structure secured to the upper, and a foot-supporting insert that is positionable within a lower area of the void and removable from the void. A system having a protrusion and an indentation may be utilized to, for example, secure the insert within the void. As an example, a protrusion may extend outward from a surface of the void, and the insert may define an indentation in a corresponding location and with a corresponding shape. When the insert is positioned within the void, the protrusion will extend into the indentation. The locations, shapes, numbers and overall configuration of the protrusion and indentation may vary significantly.

7 Claims, 20 Drawing Sheets

(56) References Cited

U.S. PATENT DOCUMENTS

| | | | | |
|---|---|---|---|---|
| 6,125,557 | A | 10/2000 | Brown | |
| 6,349,487 | B1 | 2/2002 | Hice | |
| 6,449,878 | B1 | 9/2002 | Lyden | |
| 6,601,042 | B1 | 7/2003 | Lyden | |
| 6,701,643 | B2 | 3/2004 | Geer et al. | |
| 7,010,872 | B2 | 3/2006 | Pawlus et al. | |
| 7,016,867 | B2 | 3/2006 | Lyden | |
| 7,107,235 | B2 | 9/2006 | Lyden | |
| 2003/0009915 | A1* | 1/2003 | Bacon | 36/44 |
| 2003/0200676 | A1 | 10/2003 | Gross | |
| 2005/0016028 | A1* | 1/2005 | Safdeye | 36/132 |
| 2006/0130364 | A1 | 6/2006 | Greene et al. | |

* cited by examiner

ARTICLE OF FOOTWEAR WITH A REMOVABLE FOOT-SUPPORTING INSERT

CROSS REFERENCE TO RELATED APPLICATION

This U.S. patent application is a divisional application of U.S. patent application Ser. No. 12/561,300, filed Sep. 17, 2009, now allowed, which is a divisional of Ser. No. 11/354,570 filed Feb. 13, 2006, entitled Article Of Footwear With A Removable Foot-Supporting Insert, now U.S. Pat. No. 7,600,332, issued Oct. 13, 2009, such prior U.S. patent application and patent being entirely incorporated herein by reference.

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting over pronation), and impart stability, for example. Accordingly, the upper and the sole structure operate cooperatively to provide a comfortable structure that is suited for a variety of athletic activities.

The upper forms a void on the interior of the footwear for receiving the foot. The void has the general shape of the foot, and access to the void is provided by an ankle opening. Accordingly, the upper extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, such as girth, to accommodate feet with varying proportions. In addition, the upper may include a tongue that extends under the lacing system to enhance the comfort and adjustability of the footwear, and the upper may include a heel counter to limit significant rearward, lateral, and medial movement of the heel.

The sole structure generally incorporates multiple layers that are conventionally referred to as a sockliner, a midsole, and an outsole. The sockliner is a thin, compressible member located in the void within the upper and adjacent to a plantar (i.e., lower) surface of the foot to enhance footwear comfort. The midsole, which is conventionally secured to the upper along the length of the footwear, forms a middle layer of the sole structure and is primarily responsible for attenuating ground reaction forces. The outsole forms the ground-contacting element of the footwear and is usually fashioned from a durable, wear-resistant material, such as rubber, that includes texturing or cleat elements to improve traction.

As noted above, the void formed by the upper has a shape that is suitable for receiving the foot. Individuals may, however, place additional elements within this void, such as supplemental arch supports, aftermarket sockliners, and orthotic inserts, for example. Given that the void has a shape that is suitable for receiving the foot, placing additional elements within the void displaces a portion of the volume within the void that was originally reserved for the foot. That is, placing one or more of an arch support, aftermarket sockliner, and orthotic insert within the void decreases or otherwise modifies the amount of space available for the foot and the proportions of the space available for the foot. In addition to decreasing the amount of space available for the foot, placing one or more of an arch support, aftermarket sockliner, and orthotic insert within the void has the potential to elevate the foot relative to the ground, which may increase the inversion or eversion moment at the ankle joint during use.

SUMMARY

One aspect of the invention relates to an article of footwear with an upper that defines an interior void, a sole structure secured to the upper, and a foot-supporting insert that is positionable within a lower area of the void and removable from the void. A system having a protrusion and an indentation may be utilized to, for example, secure the insert within the void. As an example, a protrusion may extend outward from a surface of the void, and the insert may define an indentation in a corresponding location and with a corresponding shape. When the insert is positioned within the void, the protrusion will extend into the indentation. As an alternative, the protrusion may extend outward from the insert, and the corresponding indentation may extend into one or both of the upper or the sole structure. The locations, shapes, numbers and overall configuration of the protrusion and indentation may vary significantly.

Another aspect of the invention is a method for manufacturing an article of footwear. The method includes a step of forming an upper with a void having dimensions corresponding with a combination of a foot and a foot-supporting insert. A protrusion is defined that extends into the void from at least one of a lower surface and a side surface of the void. An indentation is defined in the insert and at a position that receives the protrusion when a lower surface of the insert contacts the lower surface of the void. In addition, a sole structure is secured to the upper.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

The following material and accompanying figures disclose various configurations for an article of footwear with a removable foot-supporting insert. Concepts associated with footwear and insert are disclosed as being applied to footwear that is suitable for running. The concepts, however, are not limited to footwear designed for running, and may be applied to a wide range of athletic footwear styles, including baseball shoes, basketball shoes, cross-training shoes, cycling shoes, football shoes, tennis shoes, soccer shoes, walking shoes, and hiking shoes and boots, for example. The concepts may also be applied to footwear styles that are generally considered to be non-athletic, including dress shoes, loafers, sandals, and work boots. An individual skilled in the relevant art will appreciate, therefore, that the concepts disclosed herein apply to a wide variety of footwear styles, in addition to the specific style discussed in the following material and depicted in the accompanying figures.

Figure 1:
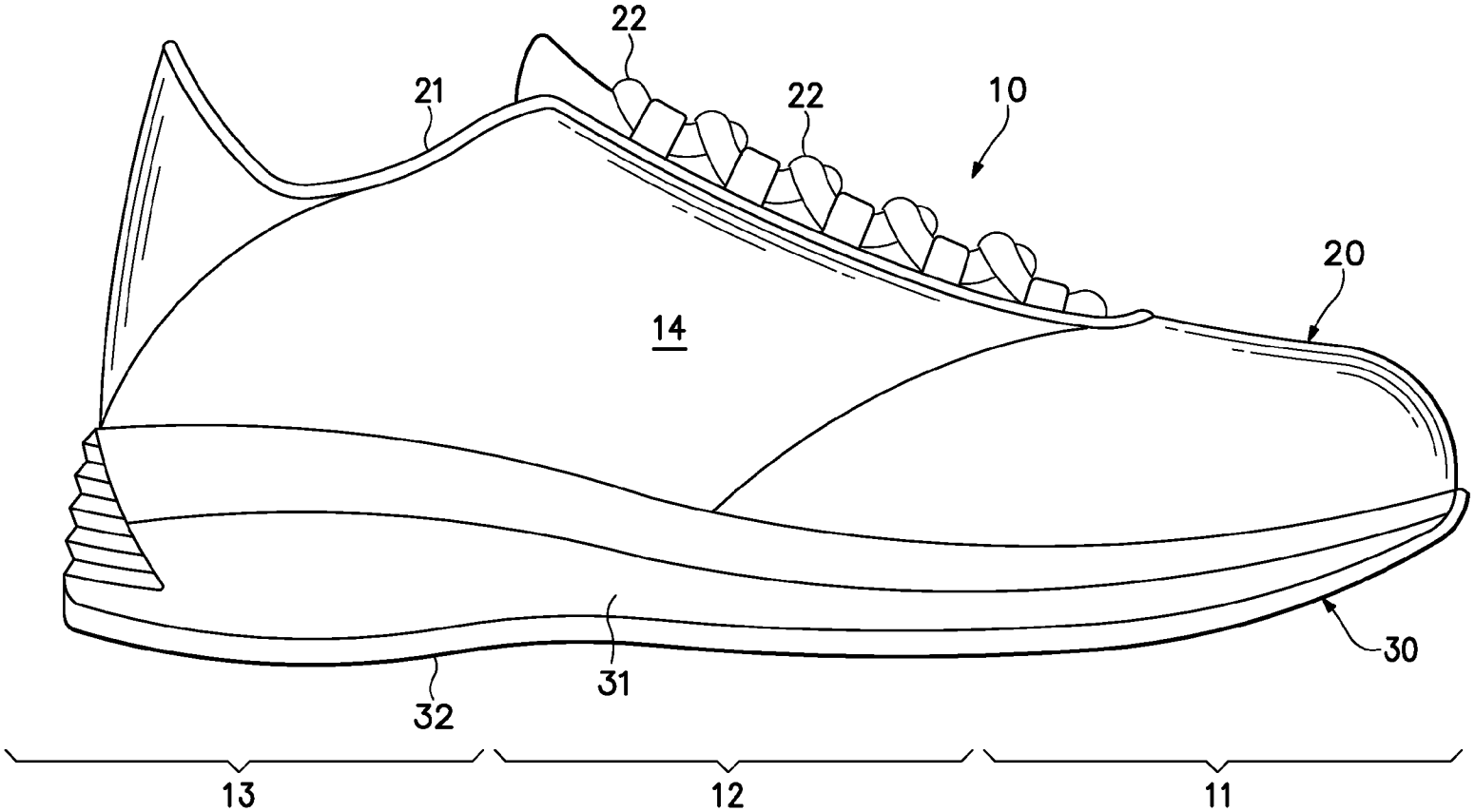
FIG. 1 is a lateral elevational view of an article of footwear having a removable insert in accordance with various aspects of the invention.
Figure 2:
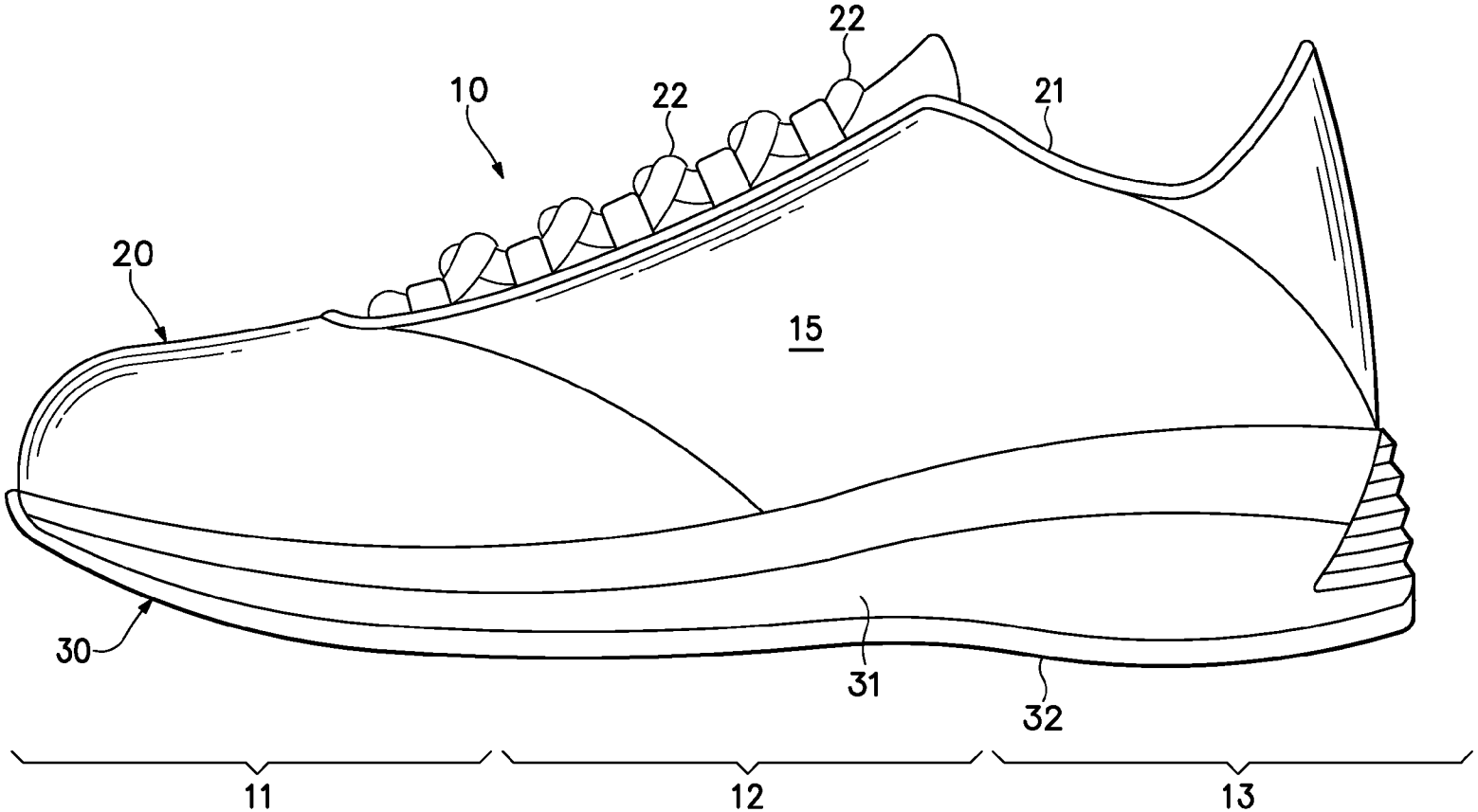
FIG. 2 is a medial elevational view of the article of footwear.
Figure 3:
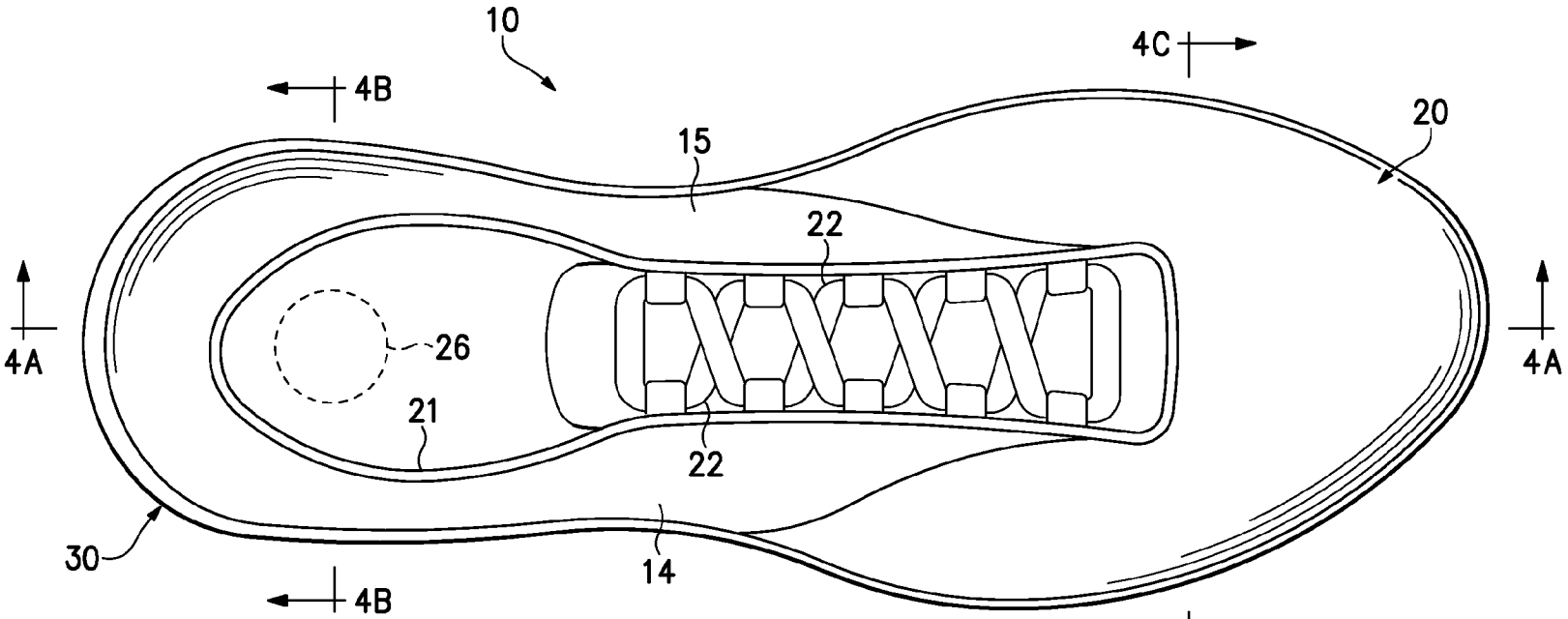
FIG. 3 is a top plan view of the article of footwear.

An article of footwear 10 is depicted in FIGS. 1-5C as including an upper 20, a sole structure 30, and an insert 40. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extends through each of regions 11-13 and correspond with opposite sides of footwear 10. More particularly, lateral side 14 corresponds with a side of the foot that includes the fifth metatarsal and fifth distal, medial, and proximal phalanges, whereas medial side 15 corresponds with a side of the foot that includes the first metatarsal and hallux. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, insert 40 and individual elements or portions thereof.

Upper 20 is depicted as having a substantially conventional configuration that incorporates a plurality of material elements (e.g., textiles, foam, leather, and synthetic leather) stitched or adhesively bonded together to form an interior void for securely and comfortably receiving a foot and insert 40. That is, the void within upper 20 is shaped to receive both the foot and insert 40. The material elements forming upper 20 may be selected and located with respect to upper 20 in order to selectively impart properties of durability, air-permeability, wear-resistance, flexibility, and comfort, for example. An ankle opening 21 in heel region 13 provides the foot and insert 40 with access to the void. In addition, upper 20 may include a lace 22 that is utilized in a conventional manner to modify the dimensions of the void and ankle opening 21, thereby securing the foot and insert 40 within the void and facilitating entry and removal of the foot and insert 40 from the void (i.e., through ankle opening 21). Lace 22 may extend through apertures in upper 20, and a tongue portion of upper 20 may extend between the void and lace 22. This configuration for upper 20 is intended to provide an example of a suitable upper for footwear 10, and practically any other conventional or non-conventional configuration for upper 20 may be utilized. Accordingly, the configuration of upper 20 may vary significantly within the scope of the present invention.

The void within upper 20 has dimensions that accommodate both the foot and insert 40. The material elements of upper 20 that form the void define various surfaces, including a lower surface 23, various side surfaces 24, and an upper surface 25. In general, lower surface 23 forms a lower area of the void and has a generally horizontal orientation that extends through each of regions 11-13. Side surfaces 24 have a generally vertical orientation that extends upward from lower surface 23 and corresponds with at least lateral side 14 and medial side 15. Upper surface 25 is spaced above lower surface 23 to form an upper area of the void. In some configurations, lower surface 23 may be formed by an element of sole structure 30.

Sole structure 30 is secured to upper 20 and may have a conventional configuration that extends between upper 20 and the ground. Sole structure 30 is depicted as including a midsole 31 and an outsole 32. Midsole 31 is formed from a polymer foam, such as ethylvinylacetate or polyurethane foam, that attenuates ground reaction forces when compressed between the foot and the ground during running, walking, or other ambulatory activities. In some configurations of footwear 10, midsole 31 may have areas of polymer foam with different densities, or midsole 31 may encapsulate a fluid-filled bladder. Outsole 32 is secured to a lower surface of midsole 31 (e.g., through an adhesive) and forms the primary ground-contacting element of footwear 10. Accordingly, outsole 32 is formed of a durable and wear-resistant material, such as rubber, and may include texturing to enhance traction. This configuration for sole structure 30 is intended to provide an example of a suitable sole for footwear 10, and practically any other conventional or non-conventional configuration for sole structure 30 may be utilized. Accordingly, the configuration of sole structure 30 may vary significantly within the scope of the present invention.

Insert 40 is depicted individually in FIGS. 6-9 and includes a primary element 41 and a textile element 42. Primary element 41 forms a majority of insert 40 and may be formed from a variety of materials, including polymers and polymer foam, that impart a shape to insert 40 corresponding with a lower portion of the void in upper 20. Primary element 41 may also be formed from a combination of different materials, such as different densities of polymer foam on each of the medial and lateral sides. Textile element 42 is secured to at least an upper area of primary element 41 and may be formed from a textile material that is bonded or otherwise secured to primary element 41. The textile material may be any of a plurality of textiles that impart one or more of comfort, perspiration control, or aesthetic appeal to insert 40. In some embodiments, textile element 42 may be absent from insert 40, or additional elements may be added to increase the comfort of insert 40 or modify the flexibility of insert 40, for example.

Insert 40 includes a lower surface 43, various side surfaces 44, and an upper surface 45. Lower surface 43 forms a lower region of insert 40 and generally corresponds in shape with lower surface 23 of the void in upper 20. Side surfaces 44 extend upward from lower surface 43 and generally correspond in shape with portions of side surface 24 of the void in upper 20. Upper surface 45 is spaced above lower surface 43 to form a foot-supporting surface of footwear 10. Whereas surfaces 43 and 44 are formed by exterior surfaces of primary element 41, upper surface 45 is formed by an exposed surface of textile element 42. Differences in the distance between lower surface 43 and upper surface 45 in each of regions 11-13 impart a tapered shape to insert 40. That is, insert 40 tapers downward from heel region 13 to forefoot region 11.

Figure 4A:
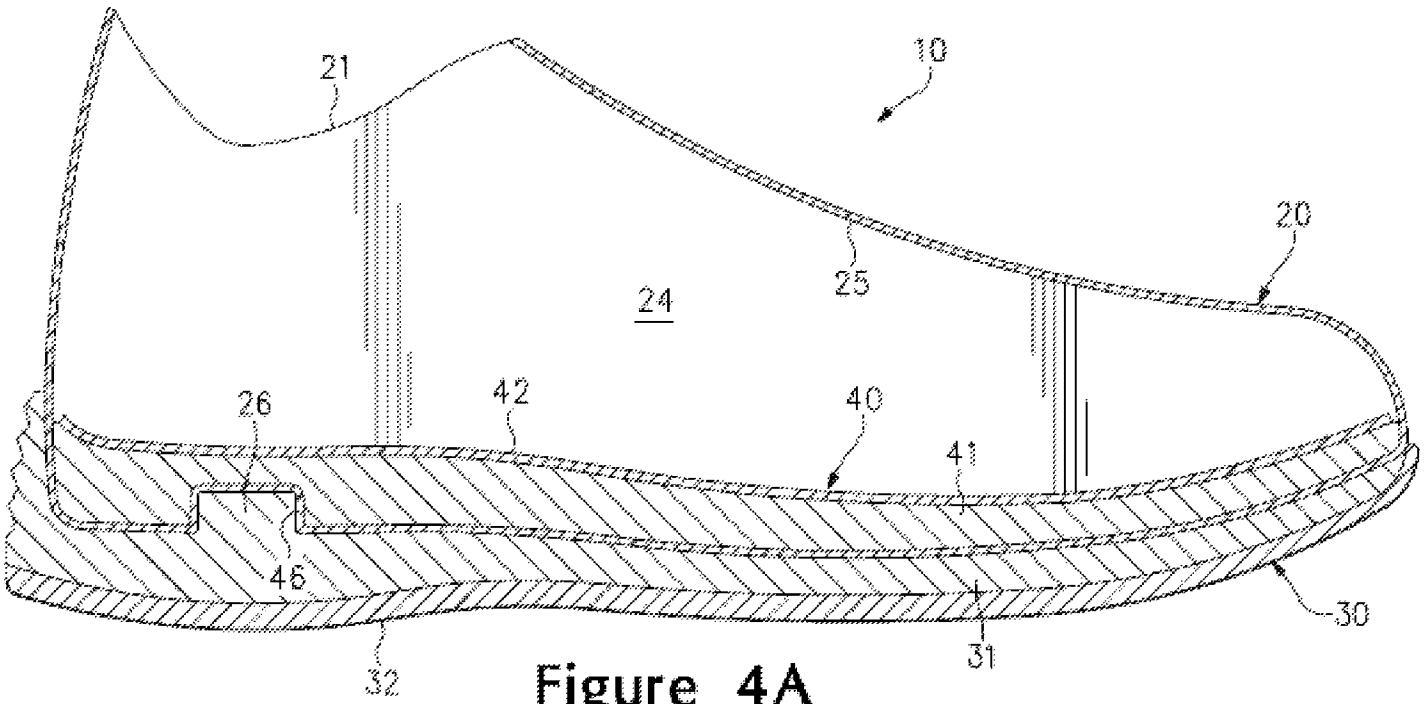
FIGS. 4A-4C are cross-sectional views of the article of footwear, as respectively defined by section lines 4A-4C in FIG. 3.
Figure 4B:
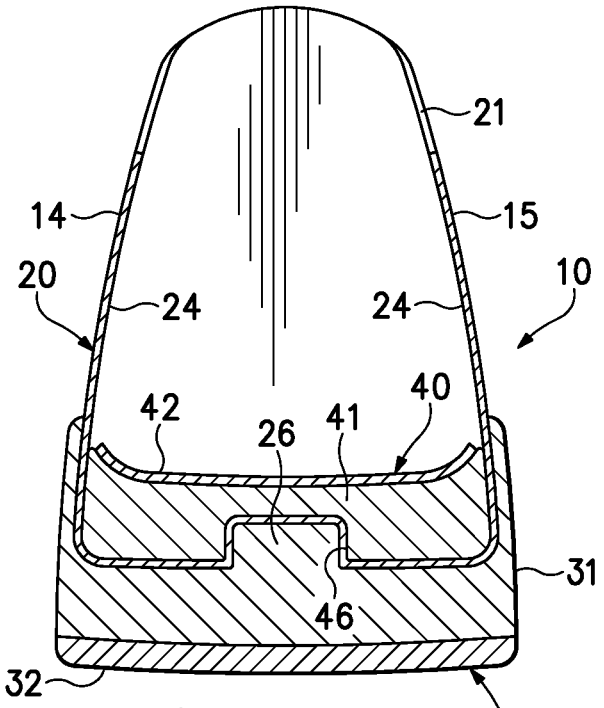
Figure 4C:
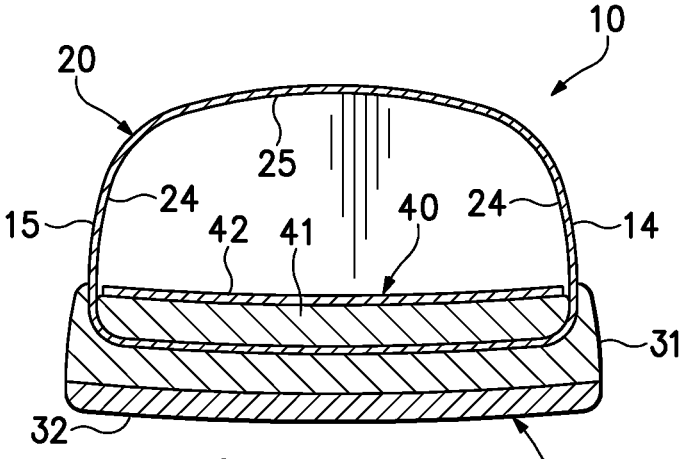
Figure 5A:
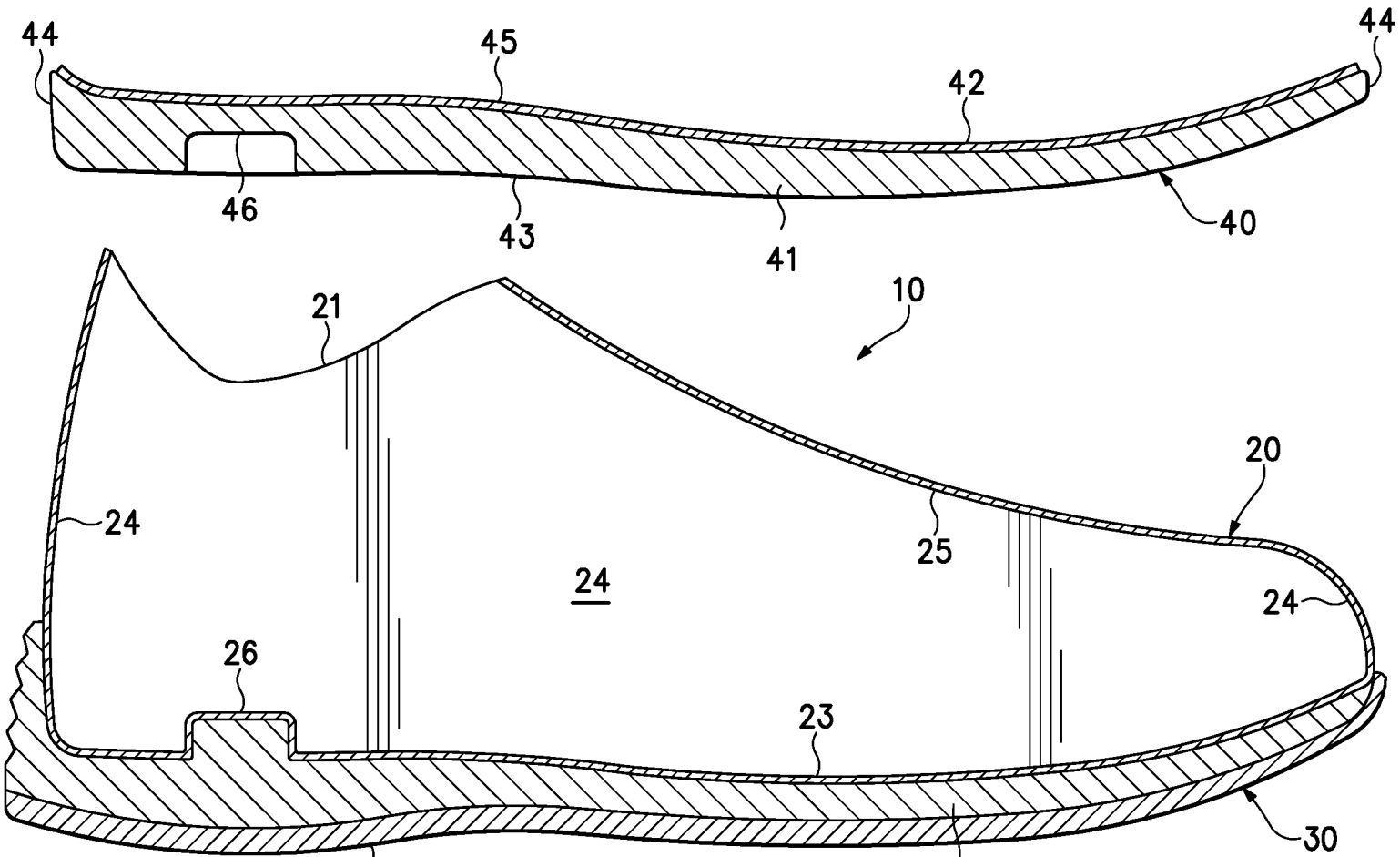
FIGS. 5A-5C are cross-sectional views of the article of footwear that respectively correspond with FIGS. 4A-4C and depict the insert as being removed from the footwear.
Figure 5B:
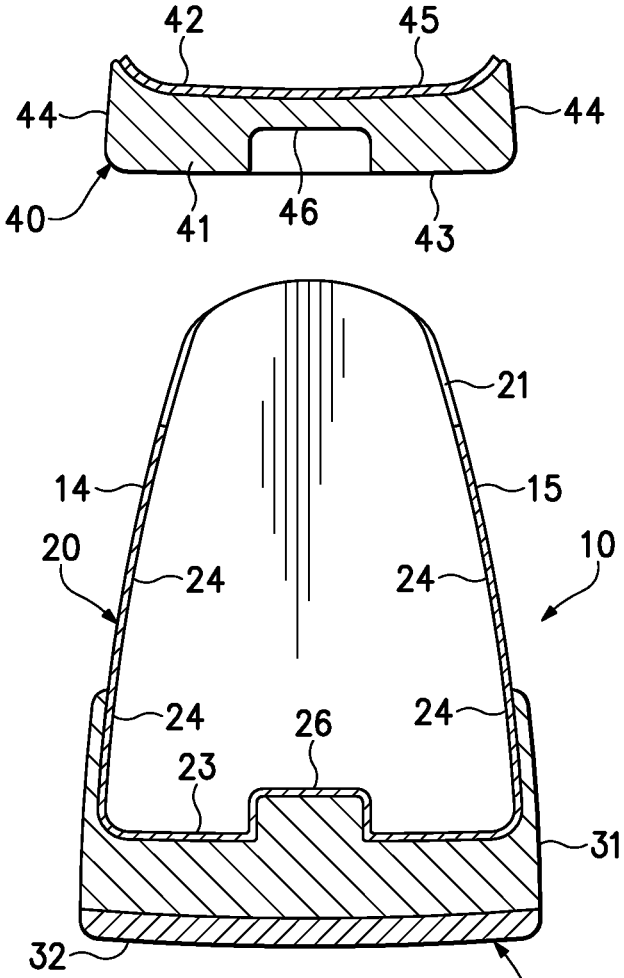
Figure 5C:
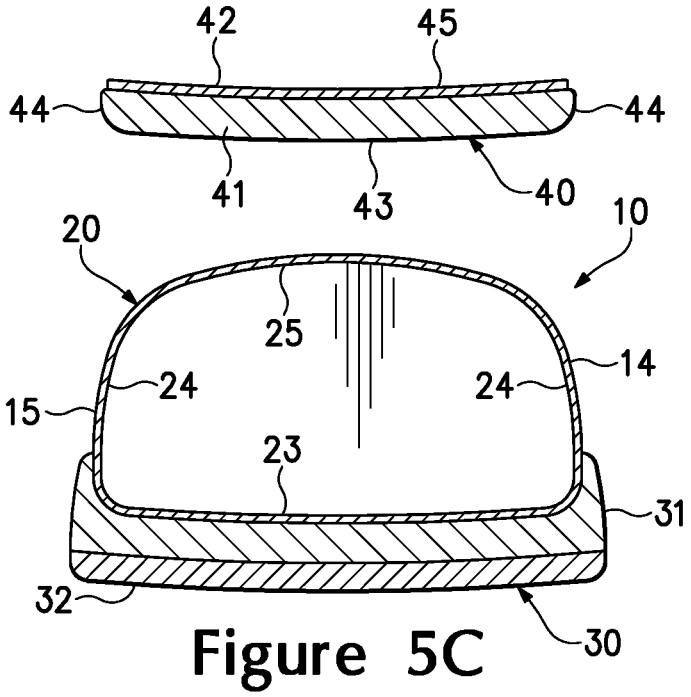
Figure 6:
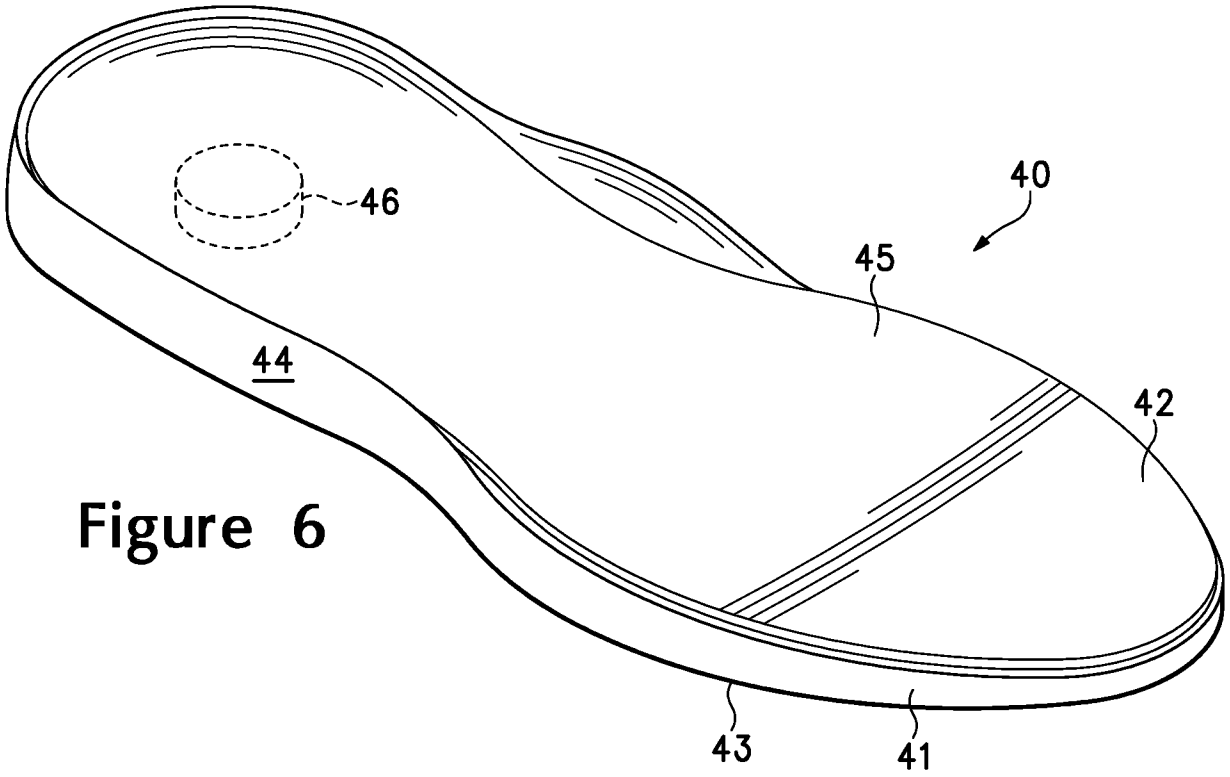
FIG. 6 is a perspective view of the insert.
Figure 7:
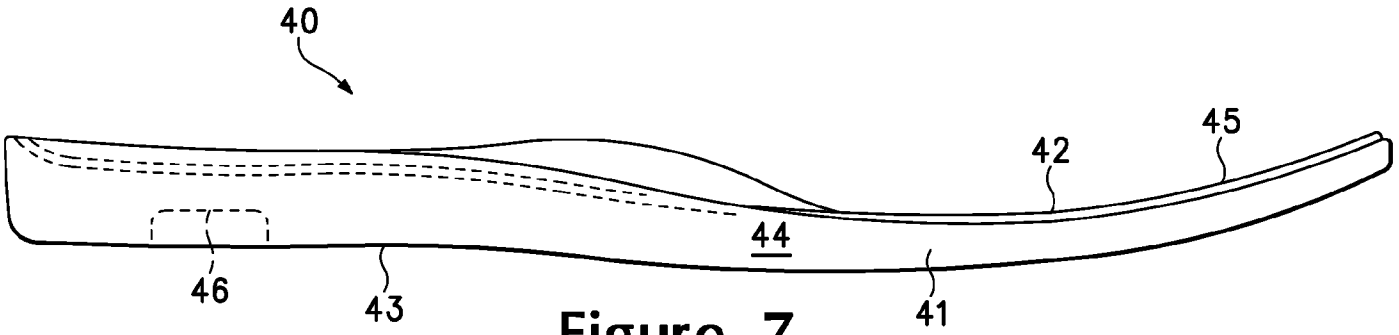
FIG. 7 is a lateral elevational view of the insert.
Figure 8:
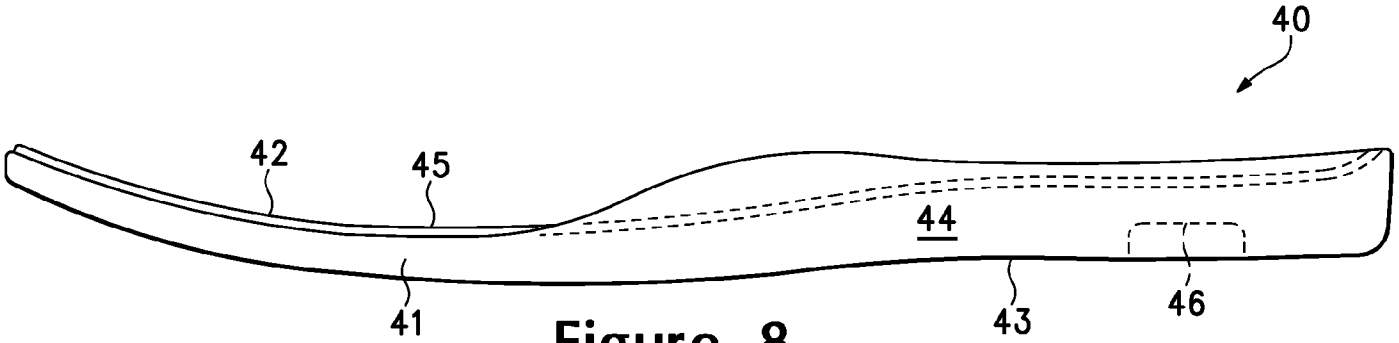
FIG. 8 is a medial elevational view of the insert.
Figure 9:
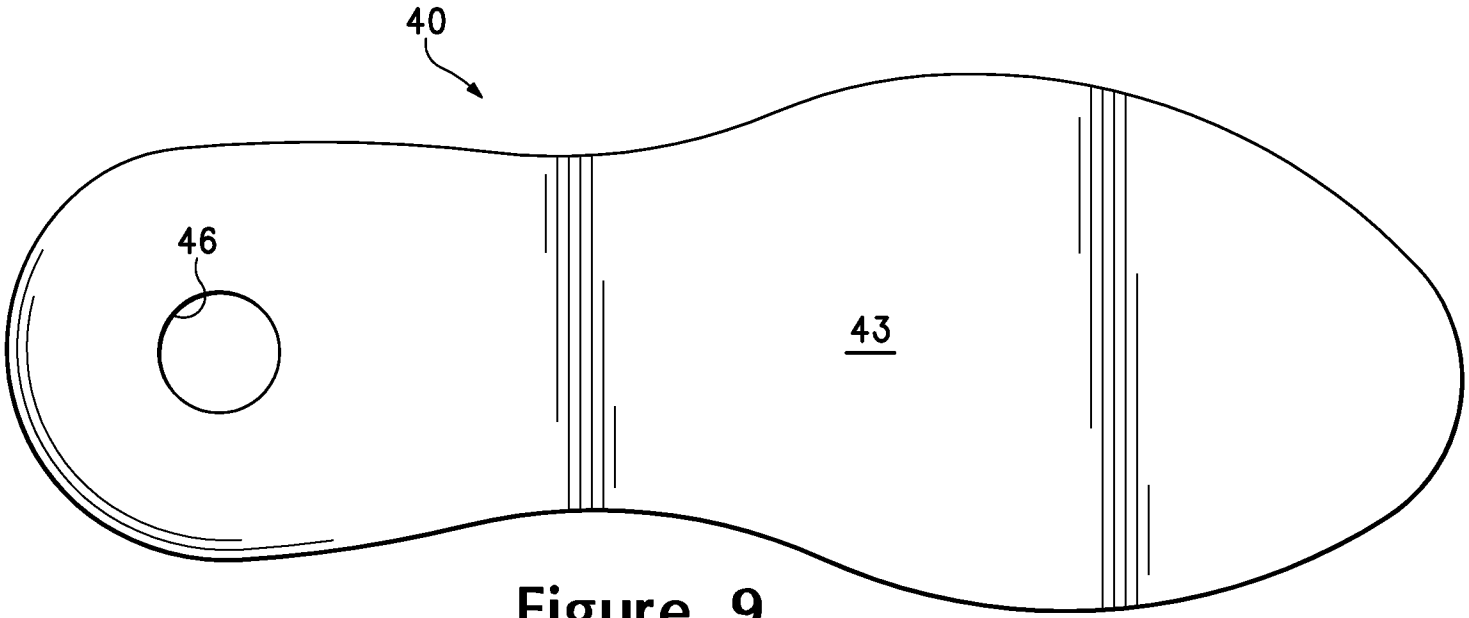
FIG. 9 is a bottom plan view of the insert.

Lower surface 43 and side surfaces 44 respectively contact or otherwise interface with lower surface 23 and side surfaces 24 when insert 40 is located within the void in upper 20. That is, the general shape of lower surface 43 and side surfaces 44 corresponds with the general shape of a lower portion of the void in upper 20. In combination, as depicted in FIGS. 4A-4C, insert 40 rests within the void such that textile element 42 (i.e., upper surface 45) provides a foot-supporting surface of footwear 10. As noted above, the void within upper 20 has dimensions that accommodate both the foot and insert 40. When insert 40 is located within the void, the remaining volume of the void has the general shape of the foot. Accordingly, the foot may be located within the remaining volume such that a lower (i.e., plantar) surface of the foot rests upon upper surface 45 and the upper surface of the foot contacts upper surface 23. Sides of the foot will also contact portions of side surfaces 24 not otherwise in contact with insert 40.

A variety of structures may be utilized to secure insert 40 within the void in upper 20. During walking, running, and other ambulatory activities, significant forces may be exerted upon various portions of footwear 10. Shear forces between lower surfaces 23 and 43, for example, may attempt to induce insert 40 to move within upper 20. In order to limit the degree of movement between insert 40 and upper 20, a securing system may be incorporated into footwear 10. A variety of securing systems are suitable for footwear 10, including adhesive systems, thermally-bonded systems, hook-and-loop fastener systems, or various mechanical systems involving fasteners. As depicted in FIGS. 4A-5C, however, the securing system includes a protrusion 26 and a corresponding indentation 46.

Protrusion 26 extends upward and into the void from lower surface 23, and indentation 46 extends upward and into insert 40. The shapes and locations of protrusion 26 and indentation 46 correspond such that protrusion 26 extends into indentation 46 when insert 40 is located within the void in upper 20. Protrusion 26 and indentation 46 have a generally circular or cylindrical shape that is located in heel region 13 and centered between side surfaces 24. In order to facilitate joining of protrusion 26 with indentation 46, both protrusion 26 and indentation 46 may be tapered. Indentation 46 extends through a portion of a distance between lower surface 43 and upper surface 45, and may extend at least half of the distance between surfaces 43 and 45. That is, indentation 46 may extend through more than half of the distance between surfaces 43 and 45, but may also extend through less than half of the distance between surfaces 43 and 45 in other configurations.

A variety of structures may form protrusion 26. Referring to FIGS. 4A and 4C, protrusion 26 is depicted as being a distension in midsole 31 that extends upward and causes the material of upper 20 at lower surface 23 to bulge inward. In some embodiments, protrusion 26 may be a separate element that is joined to lower surface 23, or protrusion 26 may be formed from a separate element that extends between midsole 31 and the material of upper 20 at lower surface 23. In further configurations, the material of upper 20 may form an aperture that the distension in midsole 31 extends through.

Insert 40 is removable from the void in upper 20. That is, protrusion 26 may be separated from indentation 46 to separate insert 40 from a remainder of footwear 10. One purpose for the removability of insert 40 relates to the customization of footwear 10. By replacing one insert 40 with another insert 40, the compressibility of insert 40 may be modified to impart different degrees of ground reaction force attenuation. Replacing one insert 40 with another insert 40 may also be utilized to change the contours of upper surface 45, thereby providing different degrees of support for the foot. As an example, one insert 40 may be exchanged with another insert 40 that has an arch area with greater height to provide additional support for the arch of the foot. As another example, one insert 40 may be exchanged with another insert 40 that is formed from a polymer foam that provides greater ground reaction force attenuation. Accordingly, replacing one insert 40 with another insert 40 permits the individual to modify the properties of footwear 10 to better suit the preferences or needs of the individual.

Another purpose for the removability of insert 40 relates to the use of an orthotic insert within footwear 10. More particularly, insert 40 may be customized to provide an orthotic insert that meets the particular needs of the individual. In order to customize insert 40, a podiatrist or other qualified specialist may form upper surface 45 to a particular shape that benefits the individual. That is, upper surface 45 may be formed to have contours that impart an orthotic quality to footwear 10. In order to accomplish this, insert 40 may be removed from footwear 10 and molded to have the contours specified by the podiatrist or other qualified specialist. Alternately, insert 40 may be formed separately from footwear 10 and with a shape that corresponds with lower surface 23, side surfaces 24, and indentation 46 such that insert 40 fits within the void in upper 20.

As noted in the Background section, the void formed by a conventional upper has a shape that is suitable for receiving the foot. Individuals may, however, place additional elements within this void, such as arch supports, aftermarket sockliners, and orthotic inserts, for example, which displaces a portion of the volume within the void that was originally reserved for the foot. By removing insert 40 and either customizing the shape of insert 40 or replacing insert 40 with a different insert 40, the benefits of utilizing an arch support, aftermarket sockliner, or orthotic insert may be gained without significantly affecting the amount of space available for the foot within the void. In addition, the benefits of utilizing an arch support, aftermarket sockliner, or orthotic insert may be gained without significantly elevating the foot relative to the ground.

In addition to providing a securing system, protrusion 26 and indentation 46 ensure that insert 40 is utilized within the void in upper 20. If, for example, the individual were to wear footwear 10 without insert 40, the presence of protrusion 26 may cause discomfort that discourages continued use of footwear 10 without insert 40. As noted above, the void within upper 20 has dimensions that accommodate both the foot and insert 40. Without insert 40, therefore, the void within upper 20 may be shaped inappropriately to accommodate the foot. Additionally, insert 40 may be formed to provide force attenuation during walking, running, or other ambulatory activities, particularly when formed from a polymer foam material. Without insert 40, footwear 10 may not provide sufficient force attenuation. Accordingly, the presence of protrusion 26 ensures that the individual utilizes footwear 10 with insert 40.

Figure 10:
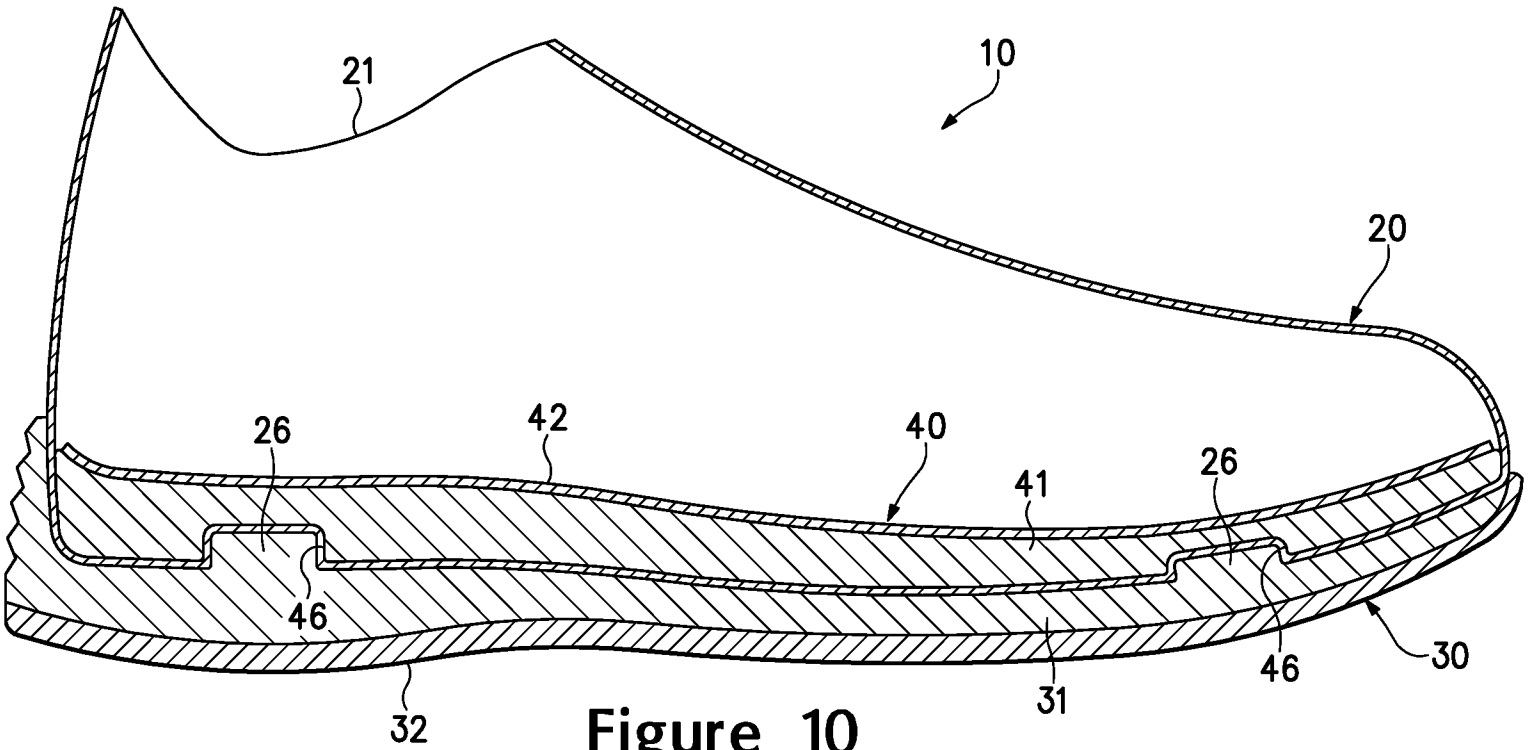
FIG. 10 is a cross-sectional view corresponding with FIG. 4A and depicting another configuration for the article of footwear.

The structure of footwear 10 discussed above provides an example of one suitable configuration for footwear 10. With reference to FIG. 10, an alternate configuration is depicted wherein footwear 10 includes a pair of protrusions 26 that extend from lower surface 23 and a pair of corresponding indentations in insert 40. As with the embodiment of FIGS. 1-9, one of protrusions 26 and indentations 46 is located in heel region 13. In FIG. 10, however, the other one of protrusions 26 and indentations 46 is located in forefoot region 11 to provide additional support against movement of insert 40 in forefoot region 11. In some configurations of footwear 10, multiple protrusions 26 and indentations 46 may be located in various areas of footwear 10. Accordingly, the numbers and locations of protrusions 26 and indentations 46 may vary significantly in footwear 10. FIG. 10 shows a corresponding number of protrusions 26 and indentations 46. In some configurations, however, different numbers of protrusions 26 and indentations 46 may be utilized.

Figures 11A, 11B, 11C:
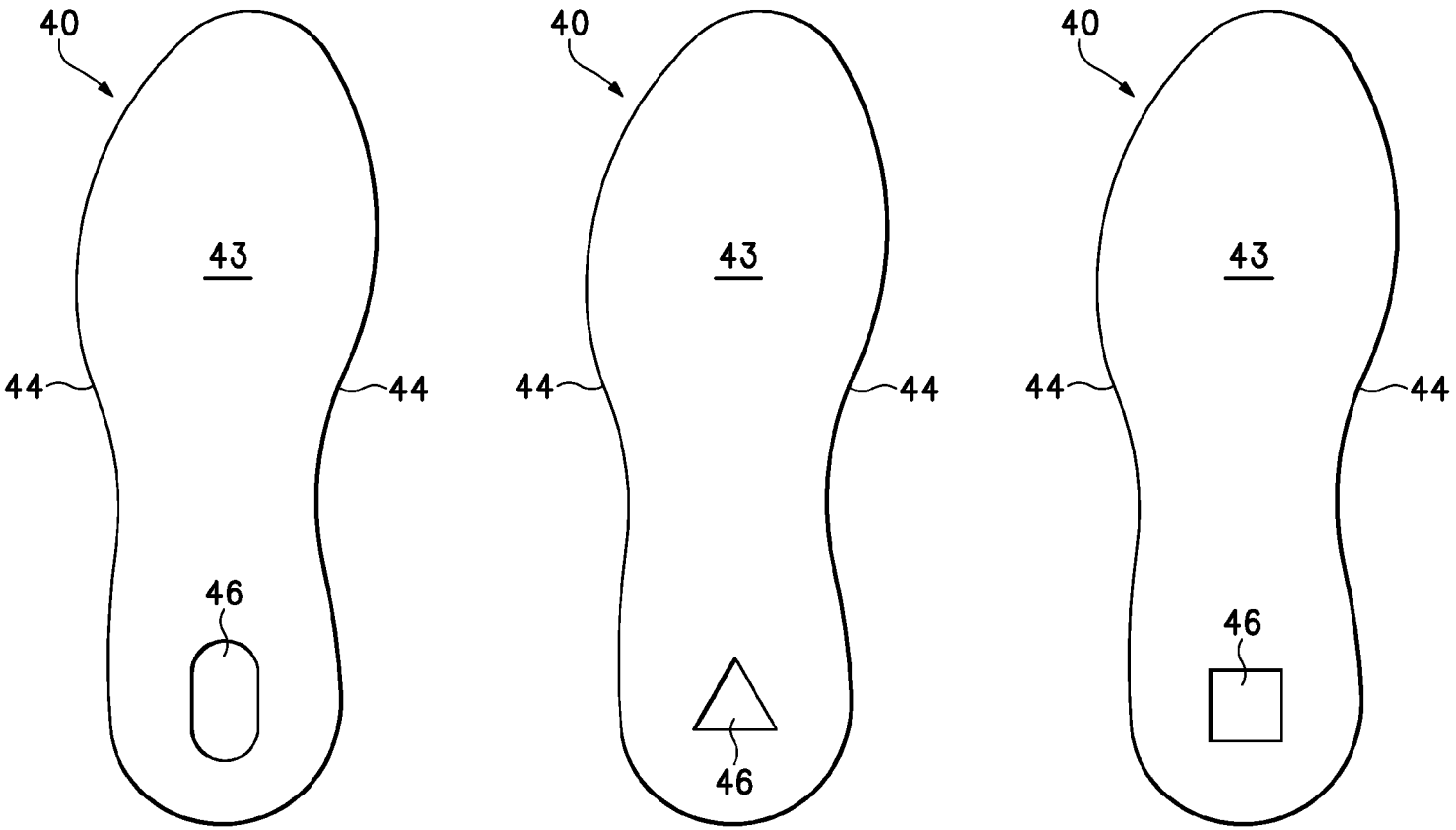
FIGS. 11A-11J are bottom plan views corresponding with FIG. 9 and depicting further configurations for the article of footwear.
Figure 11F:
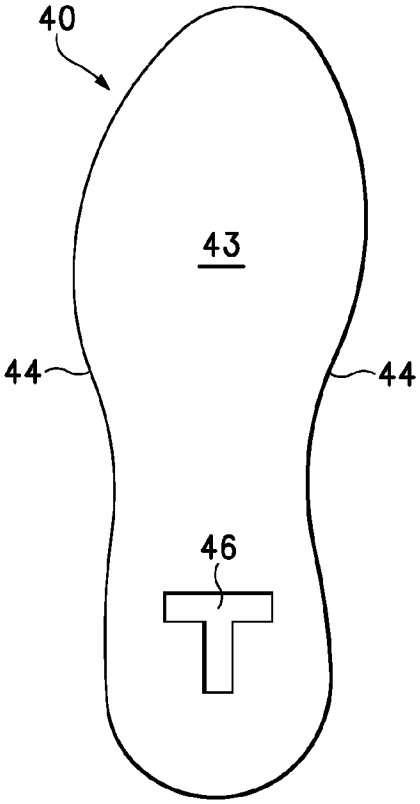
Figure 11E:
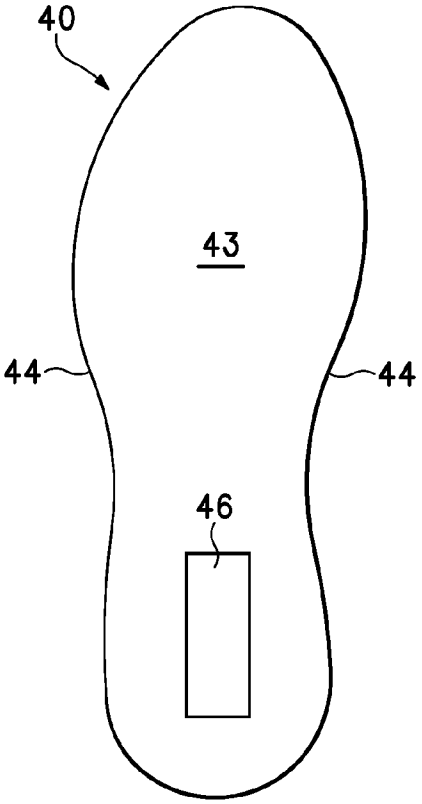
Figure 11D:
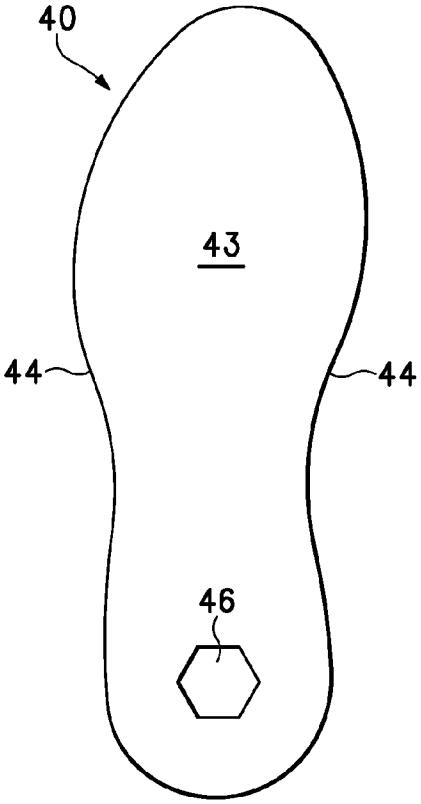
Figure 11H:
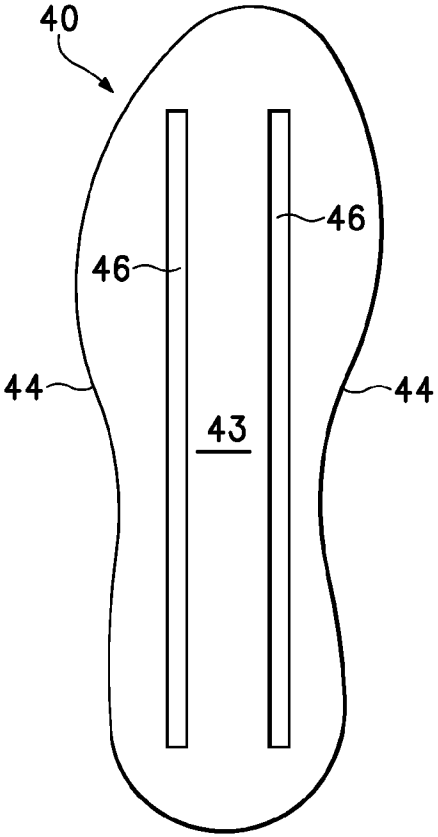
Figure 11G:
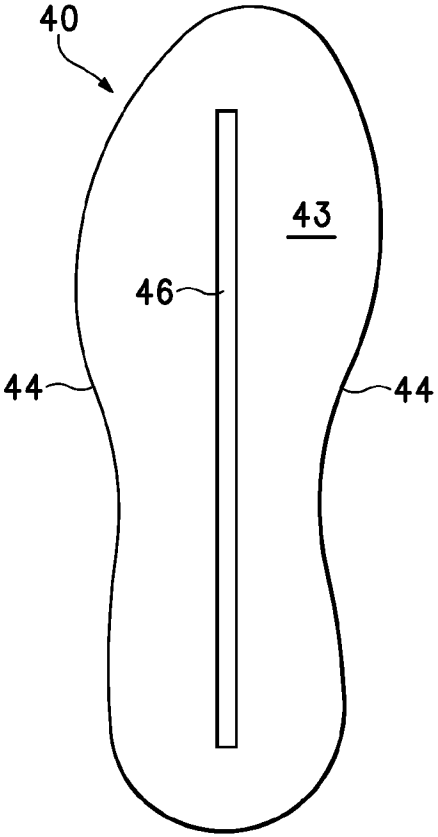
Figure 11J:
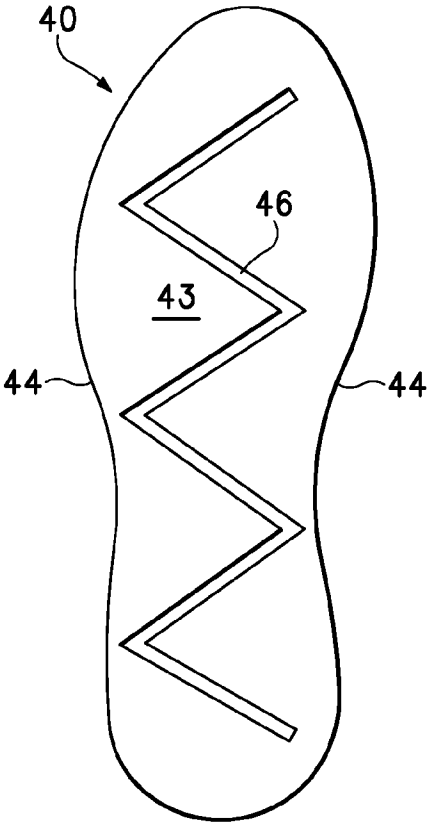
Figure 11I:
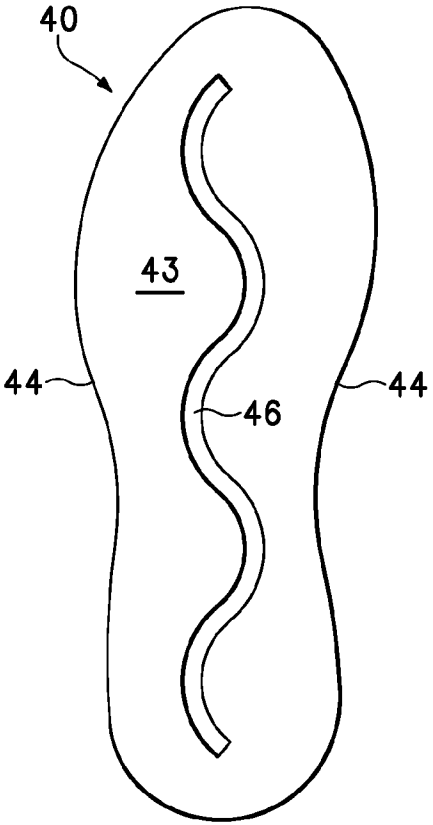

Protrusion 26 and indentation 46 are depicted in FIGS. 4A-5C and 9 as having a generally cylindrical configuration. A variety of other shapes may be utilized for protrusion 26 and indentation 46. With reference to FIG. 11A, indentation 46 is depicted as having an elliptical configuration that would correspond with an elliptical protrusion 26 extending from lower surface 23. Referring to FIG. 11B, indentation 46 is depicted as having a triangular configuration that would correspond with a triangular protrusion 26 extending from lower surface 23. Other angular configurations that include square, hexagonal, rectangular, and T-shaped may be utilized, as respectively depicted in FIGS. 11C-11F. Protrusion 26 and indentation 46 may also have various elongate configurations, and lengths of protrusion 26 may be at least five times widths of protrusion 26 and indentation 46, for example. With reference to FIG. 11G, indentation 46 is depicted as having a generally linear structure that extends through a portion of a length of insert 40. In FIG. 11H, a pair of parallel indentations 46 extend along the length of insert 40. Indentation 46 may also have wave-like or zigzag configurations, as respectively depicted in FIGS. 11I and 11J. Accordingly, the shapes of protrusion 26 and indentation 46 may vary significantly in footwear 10.

In addition to the presence of protrusion 26 and indentation 46, various locking mechanisms may be utilized to ensure that insert 40 remains securely positioned within footwear 10. For example, adhesives may be utilized to join insert 40 to footwear 10. In addition, a bar or other locking structure may extend through each of protrusion 26 and indentation 46 to lock insert 40 to footwear 10. Accordingly, various additional structures may be utilized to ensure that insert 40 remains securely positioned.

Figure 12:
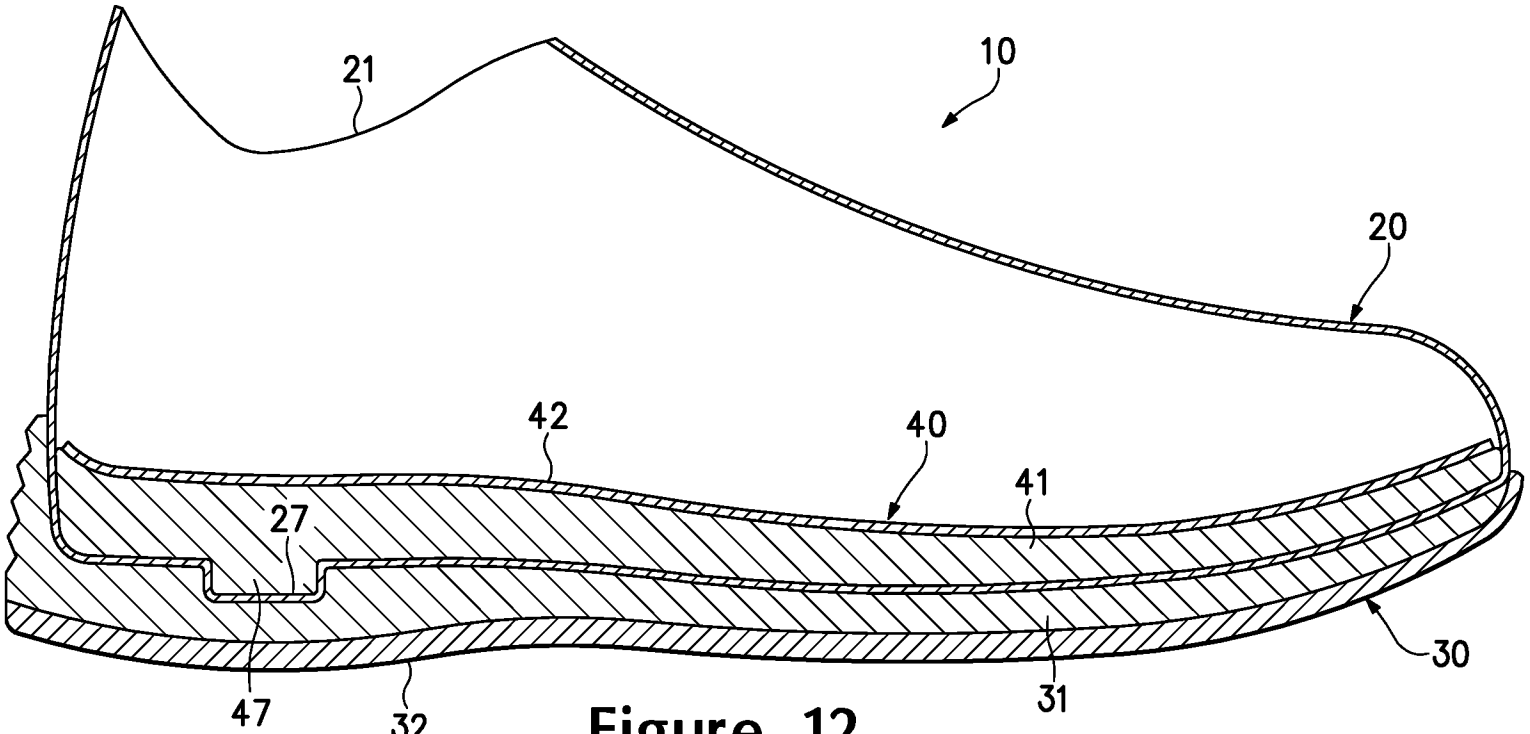
FIG. 12 is a cross-sectional view corresponding with FIG. 4A and depicting yet another configuration for the article of footwear.

The above discussion discloses a configuration wherein protrusion 26 extends from lower surface 23 and indentation 46 extends into lower surface 43. With reference to FIG. 12, a configuration is depicted wherein insert 40 forms a protrusion 47 and the void within upper 20 defines an indentation 27. More particularly, protrusion 47 extends downward from lower surface 43, and indentation 27 extends into lower surface 23 so as to form a depression in midsole 31. As with the configuration of FIGS. 1-9, the shapes and locations of protrusion 47 and indentation 27 correspond such that protrusion 47 extends into indentation 27 when insert 40 is located within the void in upper 20.

Figure 13:
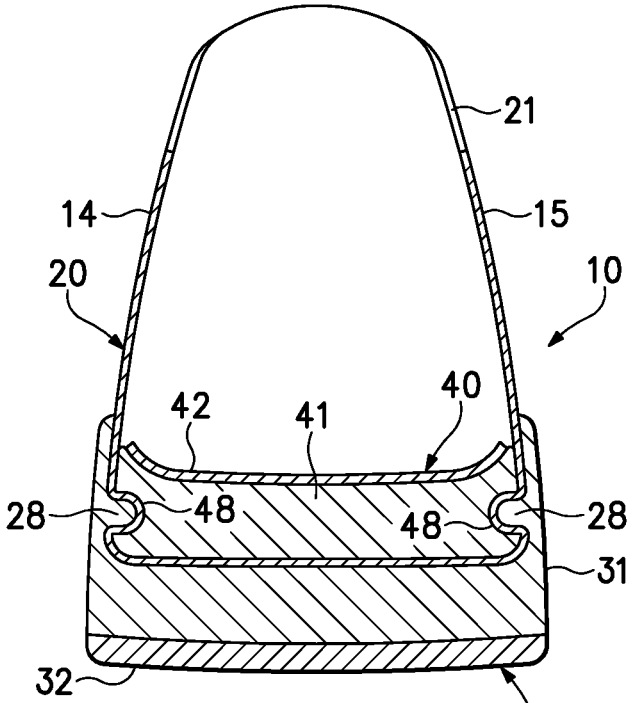
FIG. 13 is a cross-sectional view corresponding with FIG. 4B and depicting another configuration for the article of footwear.

The securing system that joins insert 40 to the remainder of footwear 10 may also be associated with side surfaces 24 and 44. With reference to FIG. 13, a pair of protrusions 28 extend outward from side surfaces 44 on both lateral side 14 and medial side 15, and protrusions 28 extend into corresponding indentations 48 in side surfaces 44 of insert 40. In some configurations of footwear 10, protrusion 28 may extend entirely around side surface 44, partially around side surface 24, or multiple protrusions 28 may be utilized. In other configurations, insert 40 may include protrusions that extend into side surfaces 24 or entirely through side surfaces 24.

Figure 14:
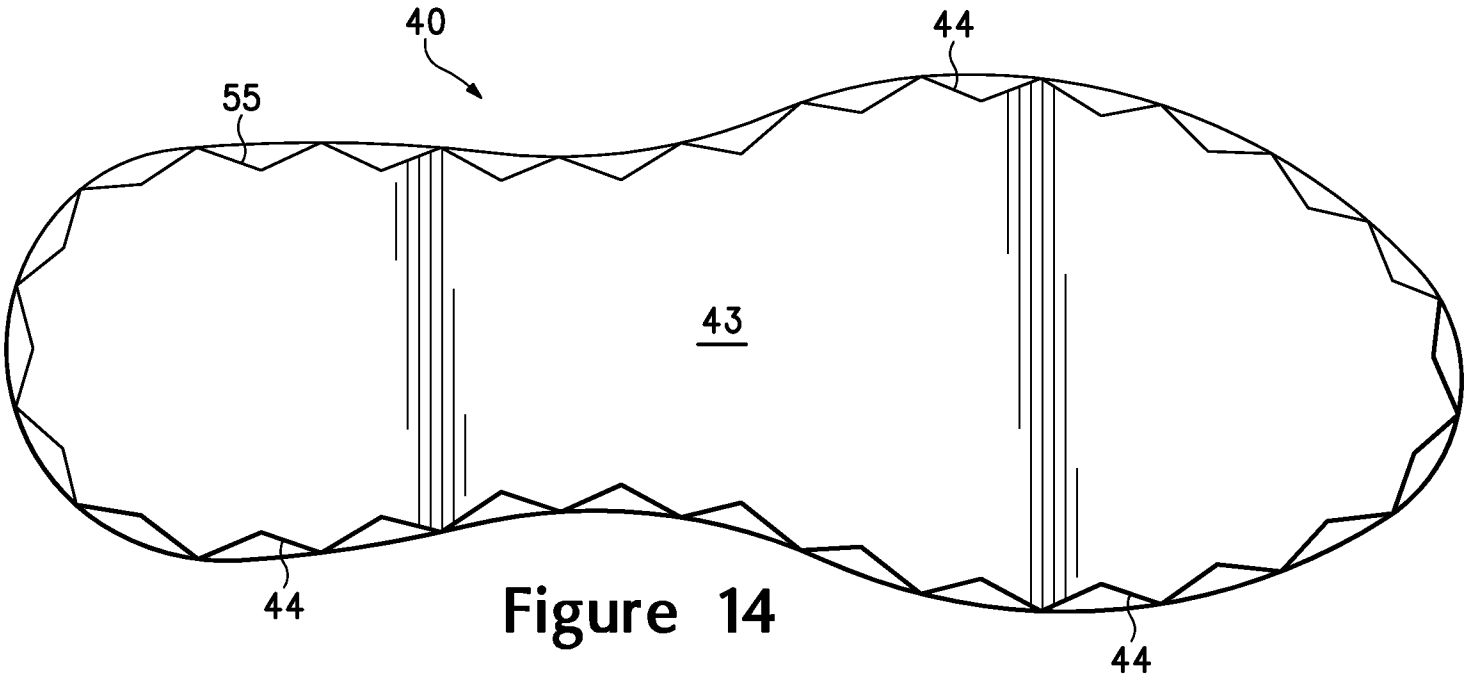
FIG. 14 is a bottom plan view of another configuration of the insert.

A similar system is depicted in FIG. 14, wherein side surfaces 44 have a zigzag configuration that mates with a similar configuration within the void in upper 20. A securing system that involves side surfaces 24 and 44 may be utilized alone to secure the position of insert 40 within the void in upper 20. In some embodiments, however, a similar securing system may be utilized in combination with a securing system associated with lower surfaces 23 and 43 (e.g., with protrusion 26 and indentation 46). That is a combination of securing systems associated with lower surfaces 23 and 43 and side surfaces 24 and 44 may be utilized.

Footwear 10 is a system of elements that operate cooperatively. As an example, midsole 31 and insert 40 may be cooperatively designed to impart support for the foot, provide stability, and attenuate ground reaction forces. Given that midsole 31 and insert 40 may be intended to operate together, the variety of shapes for protrusion 26 and indentation 46 discussed above with reference to FIGS. 10-14 may be utilized to ensure that a particular insert 40 is used within a particular midsole 31. That is, different articles of footwear 10 may use different shapes for protrusion 26 and indentation 46 in order to ensure that the correct insert 40 is utilized in a particular footwear 10, thereby limiting the degree to which one insert 40 may be used with another midsole 31. In some configurations of footwear 10, protrusions 26 and indentations 46 may have different shapes as long as protrusions 26 fit within indentations 46. For example, protrusions 26 may have triangular shapes that fit within square indentations 46, or protrusions 26 may have octagonal shapes that fit within circular indentations 46.

Based upon the above discussion, a system of one or more protrusions and corresponding indentations may be utilized to join an insert to a remainder of an article of footwear. The insert may be interchanged with other inserts, for example, to modify properties of the footwear. The insert may also be removable so as to be formed to exhibit an orthotic structure for a particular individual. Alternately, the insert may be separately formed from the footwear so as to include the orthotic structure, and the system of indentations and protrusions may be utilized to join the orthotic insert with the footwear.

Figure 15:
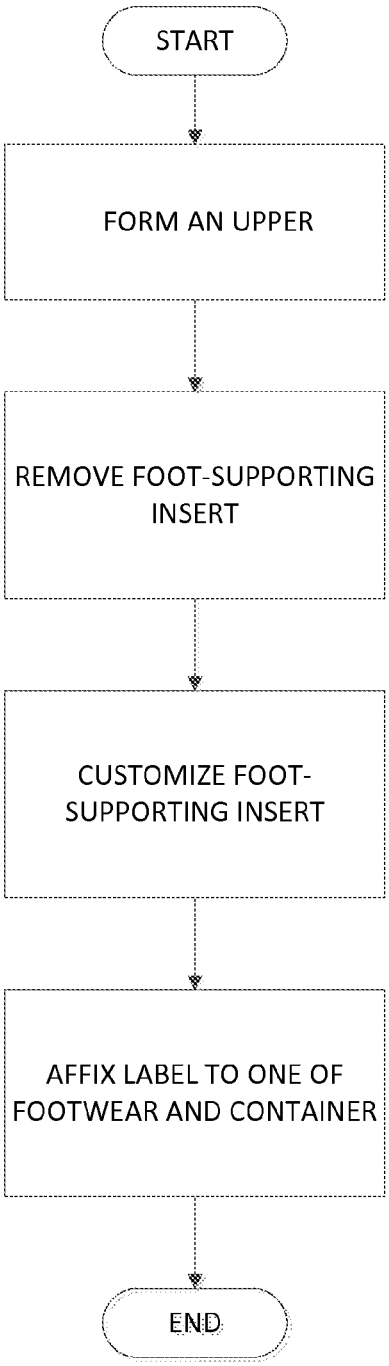
FIG. 15 is an example method of manufacturing an article of footwear according to aspects described herein.

Some conventional articles of footwear are designed with extra depth to accommodate both a foot and an orthotic. Such footwear may not have been designed, however, for athletic activities. In manufacturing footwear 10, upper 20 is formed with a void having dimensions corresponding with a combination of a foot and insert 40. As discussed above, footwear 10 may be formed for use during one or more of a variety of athletic activities. In these situations, a label may be affixed to at least one of footwear 10 and a container for footwear 10 indicating that footwear 10 is designed for an athletic activity, as shown in FIG. 15.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A method for manufacturing an article of footwear, the method comprising steps of:

forming an upper with a void having dimensions corresponding with a combination of a foot and a foot-supporting insert;

removing the foot-supporting insert and customizing the foot-supporting insert to a shape specific to a wearer;

affixing a label to at least one of the footwear and a container for the footwear indicating the footwear is designed for a particular athletic activity; forming a first portion of a securing system on a lower surface of the void in the upper and forming a corresponding second portion of the securing system in a surface of the foot-supporting insert; and wherein the forming the first portion and second portion of the securing system includes forming a tapered protrusion and a tapered indentation, with corresponding shapes, the lower surface of the void defining one of the tapered protrusion and the tapered indentation in a location that is spaced inward from side surfaces of the upper, and a lower surface of the insert defining the other of the tapered protrusion and the tapered indention, the tapered protrusion being positioned to receive the tapered indentation when the insert is positioned within the void and the lower surface of the insert contacts the lower surface of the void.

2. The method of claim 1, wherein the step of forming the upper and the void having dimensions corresponding with a combination of a foot and foot-supporting insert includes forming the upper and the void having additional depth.

3. The method of claim 1, further including forming at least one protrusion and at least one recess in the footwear and the foot-supporting insert.

4. The method of claim 3, wherein the at least one protrusion and the at least one recess have a shape that corresponds to each other.

5. The method of claim 1, wherein the foot-supporting insert is uniquely configured to fit the footwear.

6. The method of claim 1, wherein customizing the foot-supporting insert includes forming an upper surface of the foot-supporting insert to a shape that benefits the wearer.

7. The method of claim 1, wherein customizing the foot-supporting insert includes molding the foot-supporting insert to have specified contours, the contours being specified by a person other than the wearer.

* * * * *